US007234632B2

(12) United States Patent
Draghetti et al.

(10) Patent No.: US 7,234,632 B2
(45) Date of Patent: Jun. 26, 2007

(54) RIGID WRAPPER FOR A PLURALITY OF PACKETS OF CIGARETTES

(75) Inventors: Fiorenzo Draghetti, Medicina (IT); Silvano Boriani, Bologna (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 10/297,212

(22) PCT Filed: Jun. 5, 2001

(86) PCT No.: PCT/IB01/00992

§ 371 (c)(1),
(2), (4) Date: Dec. 3, 2002

(87) PCT Pub. No.: WO01/94238

PCT Pub. Date: Dec. 13, 2001

(65) Prior Publication Data

US 2003/0183541 A1 Oct. 2, 2003

(30) Foreign Application Priority Data

Jun. 7, 2000 (IT) ..... BO2000A0343

(51) Int. Cl.
*B65D 5/66* (2006.01)

(52) U.S. Cl. ..... 229/146; 206/268; 229/160.1

(58) Field of Classification Search ..... 229/146, 229/160.1; 206/268, 273
See application file for complete search history.

(56) References Cited

U.S. PATENT DOCUMENTS 3,979,047 A * 9/1976 Focke et al. ..... 229/146
5,143,213 A * 9/1992 Moore et al. ..... 229/160.1
5,634,556 A * 6/1997 Focke et al. ..... 206/268
5,651,454 A * 7/1997 Trimani ..... 206/273
5,749,462 A * 5/1998 Houghton ..... 229/160.1
6,220,430 B1 * 4/2001 Boriani et al. ..... 206/268

FOREIGN PATENT DOCUMENTS

EP 745541 A * 12/1996
WO WO-43289 A * 7/2000

* cited by examiner

*Primary Examiner*—Gary E. Elkins
(74) *Attorney, Agent, or Firm*—Timothy J. Klima

(57) ABSTRACT

A rigid carton type wrapper (1; 80; 86) for packets (2) of cigarettes is fashioned as a box-like container (8) with a hinged lid (10) erected from a flat blank (42; 81; 99) presenting a main portion (43), and an appendage (44) extending from the main portion (43) parallel with a longitudinal axis (L') of the blank; the appendage (44), which appears U-shaped and functions as a frame (27) projecting from an open end (9) of the container (8), is folded double into contact with the main portion (43) to bring the frame (27) into position relative to container (8). The wrapper (1; 80; 86) appears essentially as a rectangular parallelepiped with a predominating longitudinal axis (L), having a front face (24) and a rear face (25) disposed parallel one with another, a top end face (19) and a bottom end face (15), and two flank faces (26) lying mutually parallel and at right angles to the front and rear faces (24, 25); the front, rear and flank faces (24, 25, 26) are joined one to another by way of slender fillets or bands (38, 39, 40, 41) extending parallel to the longitudinal axis (L).

20 Claims, 8 Drawing Sheets

RIGID WRAPPER FOR A PLURALITY OF PACKETS OF CIGARETTES

TECHNICAL FIELD

The present invention relates to a rigid wrapper for a plurality of packets of cigarettes.

BACKGROUND ART

It is the conventional practice for packets of cigarettes to be packaged in multiples using rigid carton type wrappers of substantially rectangular parallelepiped shape presenting a front face and a rear face interconnected by two flank faces joined along respective sharp longitudinal corner edges.

In particular, the rigid wrapper to which the invention relates is of the type with a hinged lid, consisting in a container of cupped embodiment surmounted by a similarly cupped lid hinged to a rear edge of the selfsame container and rotatable thus between an open position and a closed position on the container.

Such a wrapper normally comprises a top end and a bottom end, a back appearing as a continuous rear face divided into two parts by a transverse hinge line connecting the lid to the container, a front appearing as two distinct portions constituting the front face of the container, and two flank faces each appearing as two portions separated by a break line and constituting one flank of the container and one flank of the lid, respectively.

The container and lid making up a rigid wrapper of the type described above are fashioned normally by bending a single diecut blank of cardboard along relative crease lines, and the wrapper is furnished generally with a frame, also of cardboard, inserted partly into the container and breasted in contact with the inside of front faces and the flank faces of the selfsame container.

The portion of the frame that projects externally of the container functions essentially as a means of reinforcing and retaining the lid when in the closed position.

It has been observed that there is a drawback associated with the use of this traditional type of carton, namely the amount of waste paper material generated per single wrapper; considering also the high numbers of such wrappers produced, the amount of waste is significant and the cost of manufacture thus increased as a result.

The object of the present invention is to set forth a rigid wrapper for a plurality of packets of cigarettes requiring a quantity of material for its manufacture less than that required for a similar parallelepiped wrapper of conventional embodiment.

A further object of the present invention is to provide a rigid wrapper for a plurality of packets of cigarettes having a distinctive visual impact, compared to a conventional parallelepiped wrapper with sharp corner edges.

DISCLOSURE OF THE INVENTION

The stated objects are realized according to the present invention in a wrapper for a plurality of packets of cigarettes, of the rigid type comprising a hinged lid and appearing substantially as a rectangular parallelepiped with a predominating longitudinal axis, presenting a front face and a rear face substantially parallel one with another, a first end face and a second end face, top and bottom respectively, and two mutually parallel flank faces perpendicular to the front and rear faces, characterized in that at least the front face or rear face is connected to one of the two adjoining flank faces by way of a longitudinal connecting element extending parallel to the longitudinal axis.

The invention will now be described in detail, by way of example, with the aid of the accompanying drawings, in which.

Figure 1:
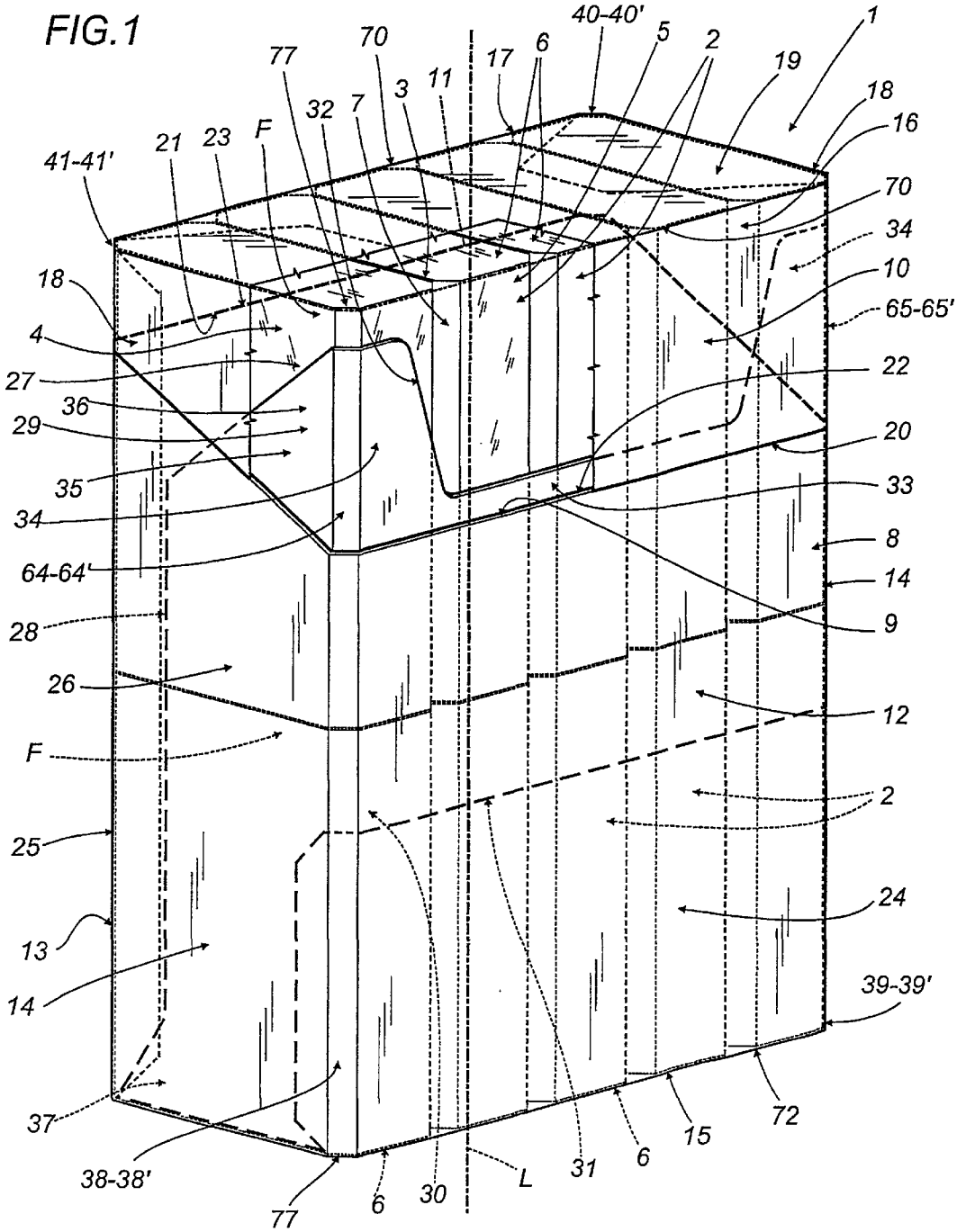
FIG. 1 illustrates a first embodiment of a rigid wrapper according to the present invention, viewed in perspective.

With reference to FIG. 1 of the accompanying drawings, 1 denotes a wrapper of substantially rectangular parallelepiped geometry referable to a predominating vertical axis L, serving to contain a plurality of packets 2 of cigarettes ordered in two rows F each composed of five packets 2 disposed one alongside another.

In particular, each packet 2 is of substantially parallelepiped geometry, presenting a front face 3 and a rear face 4, two flank faces 5, and two end faces 6. The front, rear and flank faces 3, 4 and 5 are interconnected by respective bevelled corner edges 7 each extending parallel to the longitudinal axis L.

The wrapper 1 comprises a container 8 of cupped embodiment with an open top end 9, surmounted by a lid 10 likewise of cupped embodiment; more exactly, the lid 10 is hinged to the container 8 along a relative crease line 11 and rotatable thus between a position (not indicated) in which the top end 9 is open, and a position in which the top end 9 is closed (FIG. 1).

The container presents a front face 12 and a rear face 13, mutually opposed and parallel, two flank faces 14 disposed parallel one with another and perpendicular to the front and rear faces 12 and 13, and a bottom end face 15 orthogonal to the four remaining faces 12, 13 and 14.

The lid 10 presents a front face 16 and a rear face 17, mutually opposed and parallel, two flank faces 18 disposed parallel one with another and perpendicular to the front and rear faces 16 and 17, and a top end face 19 orthogonal to the four remaining faces 16, 17 and 18. The bottom edges 20 and 21 respectively of the front and flank faces 16 and 18 and of the rear face 17 of the lid 10 are offered to the top edges 22 and 23 of the front and flank faces 12 and 14 and of the rear face 13 of the container 8. The free edge 20 of the lid 10 is matched to the free edge 22 of the container 8, whilst the edge denoted 21 is joined permanently to the corresponding edge 23 of the container 8 and combines with this same edge 23 to establish the line of the hinge 11 about which the lid 10 is rotatable between the open and closed positions. The two front faces 12 and 16 combine to make up a front face 24 of the wrapper 1, the rear faces 13 and 17 combine to make up a rear face 25 of the wrapper 1, and each pair of flank faces 14 and 18 combine to make up one corresponding flank face 26 of the wrapper 1.

Lastly, the wrapper 1 comprises a frame 27 fixed to the container 8, which presents a portion 28 disposed inside the container 8, and a portion 29 projecting from the open end 9 of the container 8 serving essentially to reinforce and to retain the lid 10 when in the closed position.

The frame 27 comprises a breast piece 30, which on the side nearer the bottom end face 15 of the wrapper 1 presents a lower edge 31 directed toward and lying parallel with the selfsame bottom end face 15, and on the side nearer the lid 10 presents a top edge 32 substantially of 'U' outline creating a central cutaway portion 33, and two shoulders 34 one on either side extending toward the lid 10. The breast piece 30 is fixed to the inside of the front face 12 in such a manner that the shoulders 34 and part of the cutaway portion 33 project beyond the aforementioned free edge 22. The frame 27 further comprises two side pieces 35 fixed to the insides of the two flank faces 14 of the container 8.

Each side piece 35 presents one end 36 projecting toward the lid 10 from the relative flank face 14 of the container 8, and an end 37 opposite from the projecting end 36 which extends down to the bottom end face 15 of the container 8.

Thus, with the lid 10 occupying the position in which the container 8 is closed, as illustrated in FIG. 1, the wrapper 1 presents a substantially rectangular parallelepiped shape. In particular, the wrapper 1 further presents four longitudinal elements 38, 39, 40 and 41 extending parallel with the longitudinal axis L, between the bottom end face 15 of the container 8 and the top end face 19 of the lid 10, by way of which the front and rear faces 12 and 13 of the container 8 are connected to the two adjoining flank faces 14 and the front and rear faces 16 and 17 of the lid 10 are connected similarly to the two adjoining flank faces 18.

In the example of FIG. 1, the elements 38, 39, 40 and 41 extend perpendicular to the bottom and top end faces 15 and 19 and consist in respective flat longitudinal fillets 38', 39' 40' and 41' each disposed at 45° to the respective interconnected adjoining faces both of the container 8 and of the lid 10.

Similarly, the frame 27 presents two longitudinal elements denoted 64 and 65, extending parallel to the longitudinal axis L, by which the shoulders 34 and breast piece 30 are connected to the two side pieces 35.

Still in FIG. 1, the two elements 64 and 65 lie perpendicular to the lower edge 31 of the breast piece 30 and appear as respective flat longitudinal fillets 64' and 65' extending between the selfsame lower edge 31 and the free top edge of the relative shoulder 34, each disposed at 45° to the respective adjoining pieces of the frame 27. More exactly, the two connecting elements 64 and 65 of the frame are sandwiched between two respective elements 38 and 39 of the wrapper and the corresponding bevelled corner edges 7 of the packets 2 at each end of the two rows F.

Figure 2:
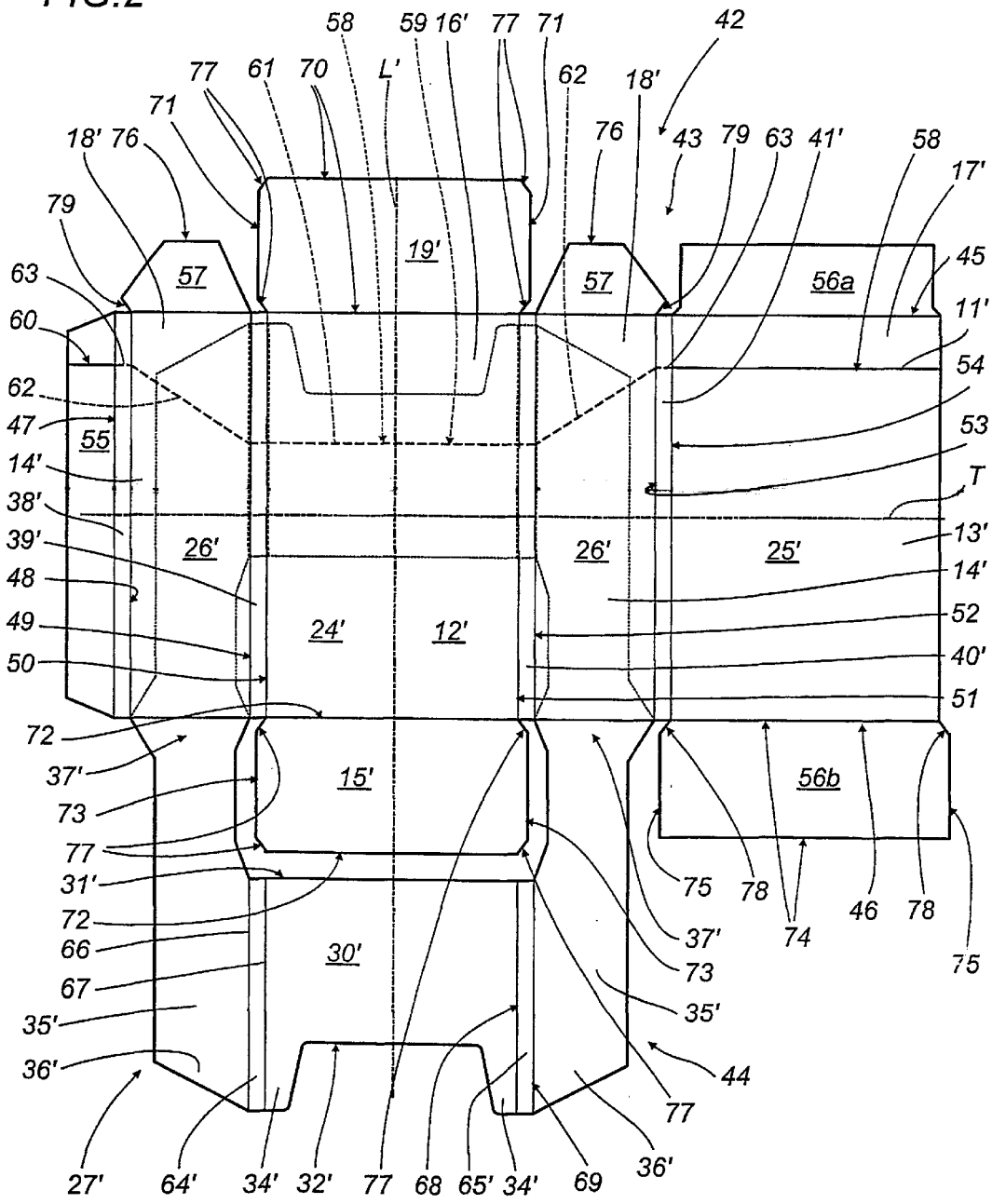
FIG. 2 is the plan view of a diecut blank from which to fashion the wrapper of FIG. 1.

With reference now to FIG. 2, the wrapper 1 is fashioned by bending a flat diecut blank 42 of cardboard or other similar material, incorporating the container 8, the lid 10 and the frame 27, of which the component parts will be indicated where possible using the same numbers, primed, as those used to indicate the corresponding parts of the erected wrapper 1.

The flat blank 42 presents a first longitudinal axis L' and a second transverse axis T normal to the first axis L', and comprises a main portion 43 aligned on the transverse axis T, which ultimately will provide the container 8 and the lid 10 of the wrapper 1, and a longitudinal appendage 44 aligned on the first axis L' which ultimately will provide the frame 27 of the wrapper 1.

The main portion 43 of the blank presents a first and a second transverse crease line denoted 45 and 46, extending parallel to the transverse axis T, and a plurality of first longitudinal crease lines denoted 47 . . . 54, viewing left to right in FIG. 2 along the transverse axis T.

The first longitudinal crease lines 47 . . . 54 extend parallel to the aforementioned longitudinal axis L' and combine with the first and second transverse crease lines 45 and 46 to delimit a front central panel 24', between the two lines denoted 50 and 51, two lateral portions 26' lying one on either side of the central panel 24' of which that on the left (as viewed in FIG. 2) is compassed between the two lines denoted 48 and 49 and that on the right between the two lines denoted 52 and 53, also an end panel 25' located externally of the lateral portion 26' on the right, to the right of the line denoted 54, and a longitudinal end flap 55 located externally of the lateral portion 26' on the left, to the left of the remaining longitudinal crease line 47.

The end flap 55 is connected to the adjoining lateral portion 26' by way of a first fillet 38' delimited by and extending between the two crease lines denoted 47 and 48; the central panel 24' is connected to the lateral portion 26' on the left, as seen in FIG. 2, by way of a second fillet 39' delimited by and extending between the two lines denoted 49 and 50, and similarly to the lateral portion 26' on the right by way of a third fillet 40' delimited by and extending between the lines denoted 51 and 52; the end panel 25' is connected to the adjoining lateral portion 26' on the side opposite the central panel 24' by way of a fourth fillet 38' delimited by and extending between the crease lines denoted 53 and 54.

The four longitudinal fillets 38', 39', 40' and 41' present a small transverse dimension and are identical one to another.

The central panel 24' extends at the two opposite longitudinal extremities into first end folds 19' and 15' to which it is joined respectively along the first transverse crease line 45 and along the second transverse crease line 46.

Similarly, the end panel 25' extends at the two opposite longitudinal extremities respectively into a second end fold 56*a*, to which it is joined along the first transverse crease line 45, and a third end fold 56*b* to which it is joined along the second transverse crease line 46, whilst each of the two lateral portions 26' extends at the longitudinal extremity delimited by the first transverse crease line 45 into a relative transverse end flap 57.

The main portion 43 of the blank also exhibits a third transverse line denoted 58 in its entirety, occupying a position between the first and second transverse crease lines 45 and 46, which comprises a creased leg 11' extending parallel with these same lines 45 and 46 across the end panel 25' and coinciding with the aforementioned hinge line 11, also two perforated legs 59 and 60 of which the first extends across the central panel 24', the two lateral portions 26' and the four fillets 38', 39', 40' and 41', and the second across the longitudinal end flap 55. In particular, the first such leg 59 consists in a central portion 61 extending parallel with the first and second crease lines 45 and 46 across the central panel 24' and across the two associated fillets 39' and 40' one on either side, also two oblique and oppositely angled intermediate portions 62 which extend respectively across the two lateral portions 26', and two end portions 63 extending parallel to the first and second crease lines 45 and 46 across the remaining fillets 38' and 41'.

The third transverse line 58 thus divides each lateral portion 26' into two portions 14' and 18', while dividing the central panel 24' into two panels 12' and 16' and the end panel 25' into two panels 13' and 17', and dividing each fillet 38', 39', 40', and 41' into two fillets relative to the container 8 and to the lid 10.

The appendage 44 is of substantially U shaped appearance and comprises two lateral arms 35', also a transverse panel 30' interposed between the two arms 35', with which they are associated by way of two fillets 64' and 65'. In particular, the two fillets 64' and 65' are compassed between relative pairs of longitudinal crease lines denoted 66 and 67 on the left and 68 and 69 on the right as viewed in FIG. 2.

More precisely, the one fillet 64' (on the left in FIG. 2) extends between two crease lines 66 and 67 aligned longitudinally with the crease lines of the main portion 43 denoted 49 and 50, whilst the other fillet 65' (on the right in FIG. 2) extends between two crease lines 66 and 69 aligned longitudinally with the crease lines of the main portion 43 denoted 51 and 52.

The appendage 44 is joined by the ends 37' of the two arms 35' to the respective lateral portions 26' of the main portion 43 of the blank 42, hinged to the longitudinal ends of these same portions 26' which coincide with the second transverse crease line 46, and surrounds the first end fold 15' of the central panel 24'.

Before the folding operation proper is performed on the blank 42, the appendage 44 is bent double, rotated through 180° about the second transverse crease line 46 and into contact thus with the main portion 43. More exactly, the appendage 44 is bent along the crease line 46 to the point of flattening the transverse panel 30' against the inside face of the central panel 24', the arms 35' against the inside faces of the relative lateral portions 26', and the fillets 64' and 65' against the respective fillets 39' and 40' of the main portion 43.

Thereafter, the longitudinal end flap 55 and the end panel 25' are bent at right angles to the two adjoining lateral portions 26' and, with the two lateral portions 26' bent at right angles to the central portion 24', the end panel 25' is caused to overlap with the end flap 55 in such a manner that the free edge of the panel 25' coincides with the longitudinal crease line 47 bordering the flap 55; the end panel 25' constitutes the rear face 25 of the wrapper 1, whilst the central panel 24' becomes the front face 24 and the two lateral portions 26' become the flank faces 26.

In similar fashion, the one first end fold 19', the second end fold **56*a* and the two transverse end flaps 57 are bent along the first transverse crease line 45 at right angles respectively to the central panel 24', end panel 25' and lateral portions 26', whilst the other first end fold 15' and the third end fold 56*b* are bent along the second transverse crease line 46 at right angles respectively to the central panel 24' and to the end panel 25', so that when the longitudinal end flap 55 and end panel 25' are bent at right angles to the respective lateral portions 26', and the lateral portions 26' in turn bent at right angles to the central portion 24', the first end fold 19', second end fold 56*a* and transverse end flaps 57 at one end will overlap to form the top end face 19 of the lid 10, whilst the first end fold 15' and the third end fold 56*b* at the opposite end will overlap to form the bottom end face 15 of the container 8**.

It will be observed also that the one first end fold 19' is compassed peripherally by two mutually opposed longer transverse side edges 70 of which one, and more exactly the edge nearer the central panel 24', coincides with the first transverse crease line 45, and by two mutually opposed shorter longitudinal side edges 71. In like manner, the other first end fold 15' is compassed peripherally by two mutually opposed longer transverse side edges 72, the edge nearer the central panel 24' coinciding with the second transverse crease line 46, and two mutually opposed shorter longitudinal side edges 73.

Similarly, the third end fold **56*b* is compassed peripherally by two opposing longer transverse side edges 74 of which one, and more exactly the side nearer the central panel 24', coincides with the second transverse crease line 46, and two opposing shorter longitudinal side edges 75. In particular, the third end fold 56*b* is larger than the second end fold 56*a*, which serves simply to enclose the top end face 19**.

In addition, each transverse end flap 57 exhibits a peripheral edge 76 forming a loop with the first transverse crease line 45, along which the flaps 57 are joined to the respective lateral portions 26'.

According to the invention, and as illustrated in FIG. 2, each first end fold 19' and 15' presents four respective first connecting profiles 77 which extend at 45° between imaginary continuations of the crease lines denoted 49 and 50 and the crease lines denoted 51 and 52. The profiles 77 adjoining the two transverse edges 70 and 72 of the relative first end folds 19' and 15' which coincide with the central panel 24' lie adjacent to the respective transverse crease lines 45 and 46, connecting the selfsame end folds 19' and 15' to the panel 24'.

In like manner, the third end fold **56*b* presents respective third connecting profiles 78 associated at least with the two opposite ends of the longer transverse edge 74 joined to the end panel 25' and adjacent to the second transverse crease line 46, extending respectively between the longitudinal crease lines denoted 53 and 54 and beyond the free longitudinal edge of the panel 25'**.

In addition, each transverse end flap 57 presents a second profile 79 associated with the end of the peripheral edge 76 nearer the end panel 25' and nearer the longitudinal end flap 55, respectively, connecting the selfsame peripheral edge 76 with the first transverse crease line 45.

Still in FIG. 2, it will be observed that the width of each first end fold 19' and 15', measured along a direction parallel to the transverse crease lines 45 and 46, is less than the overall width of the central panel 24' plus the adjacent fillets 39' and 40', and the width of the third end fold **56*b* as measured along the same transverse direction is less than the overall width of the end panel 25' plus the fillet 41' by way of which the panel 25' is associated with the one lateral portion 26' and the fillet 38' by way of which the longitudinal end flap 55 is associated with the remaining lateral portion 26'; each transverse end flap 57 exhibits a substantially trapezoidal outline disposed with the greater base nearer to the first transverse crease line 45, and the distance that each of the second connecting profiles 79 projects transversely into the space at the end of the respective fillet 38' and 41' is less than the width of the selfsame fillet 38' and 41'**.

Moreover, the height of the first end folds 19' and 15', as measured along a direction parallel to the longitudinal crease lines 49 . . . 52, is less than the overall width of the lateral portions 26' plus that of the two respective fillets 39' and 41', so that when the parts of the blank are bent and rotated as described above, the first profiles 77 of the one first end fold 19' and the second profiles 79 of the transverse end flaps 57 will coincide, as also will the first profiles 77 of the remaining first end fold 15' and the third profiles 78 of the third end fold **56*b*, to establish shaped edges bordering the top end face 19 and the bottom end face 15**.

In addition, when the parts of the blank 42 have been bent and rotated, the four fillets 38', 39', 40' and 41' will be disposed in such a manner that the relative free edges coinciding with the first and second transverse crease lines 45 and 46 remain in contact with the corresponding first profiles 77 though without being connected thereto.

In other words, and referring to FIG. 1, each of the aforementioned four longitudinal connecting elements 38, 39, 40 and 41 presents two respective opposite axial extremities extending along though not connected to corresponding portions coinciding with the first profiles 77 at either end of the longer side edges 70 and 72 and the shorter side edges 71 and 73 respectively of the top and bottom end faces 19 and 15.

Thanks to the inclusion of the fillets 38', 39', 40' and 41', the transverse dimension exhibited by the main portion 43 of the blank 42, measured along the relative axis T, is less than the corresponding dimension exhibited by the main portion of a blank as used conventionally in fashioning a comparable parallelepiped rigid wrapper with hinged lid having sharp corner edges; and similarly, in the case of the frame 27, with the arms 35' and the transverse panel 30' of the appendage 44 also interconnected by fillets 64' and 65', the transverse dimension of the appendage 44 as measured along the relative axis T is less than the corresponding dimension exhibited by the appendage of a conventional blank used to fashion a comparable parallelepiped rigid wrapper with hinged lid having sharp corner edges.

Figure 3:
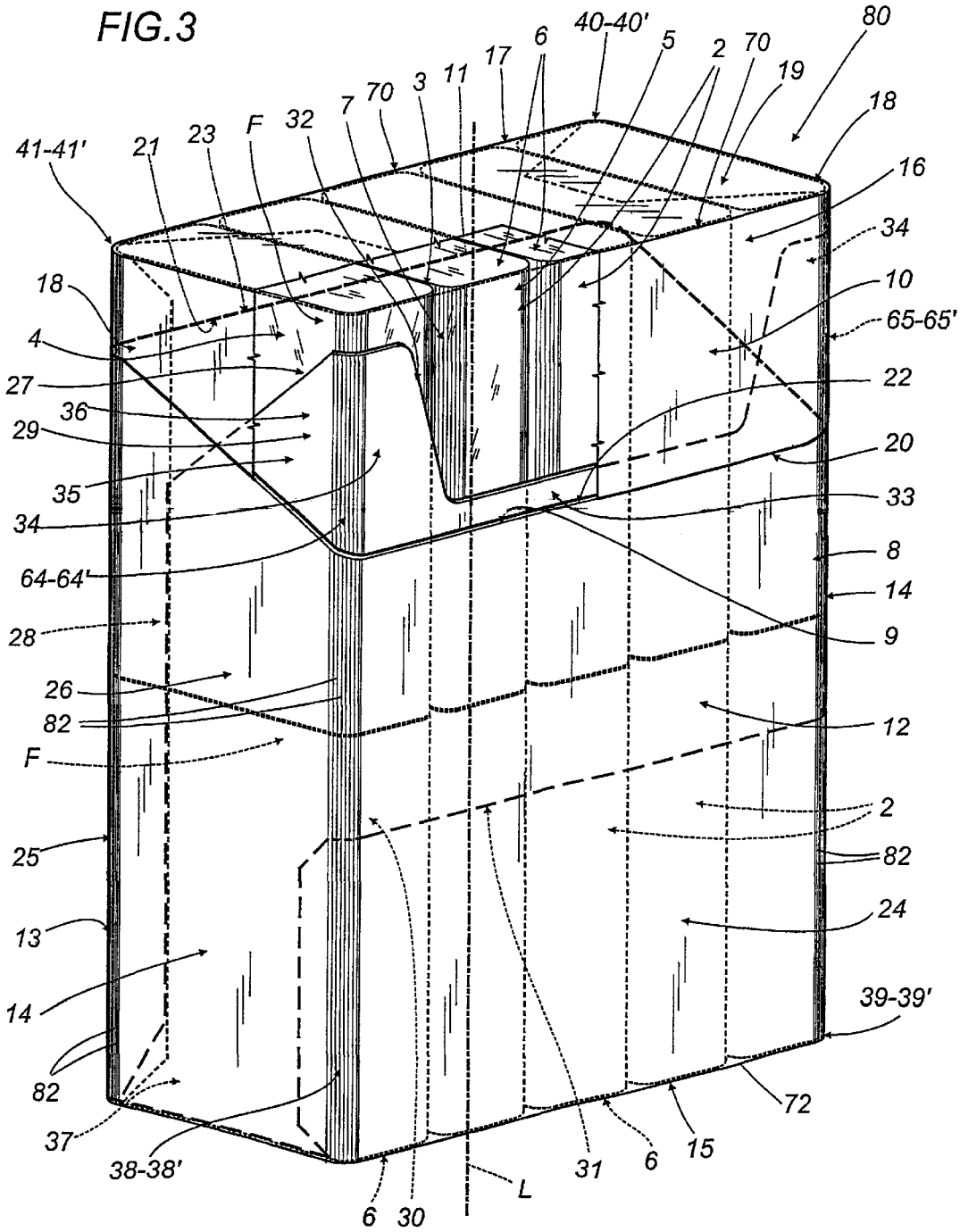
FIG. 3 illustrates a second embodiment of a rigid wrapper according to the present invention, viewed in perspective.

FIG. 3 illustrates a wrapper 80 designed to contain packets 2 of which the front face 3, rear face 4, two flank faces 5 and two end faces 6 are interconnected by respective rounded corner edges 7 each extending parallel to the longitudinal axis L.

The wrapper 80 in question is notably similar to the wrapper 1 of FIG. 1, and the various parts are denoted where possible by the same reference numbers as used to identify the corresponding parts of this same wrapper 1.

In the wrapper 80 of FIG. 3 the four connecting elements 38, 39, 40 and 41 consist in respective radiused fillets 38', 39' 40' and 41' such as will generate rounded corner edges on the wrapper 80, each exhibiting a curved cross section.

Figure 4:
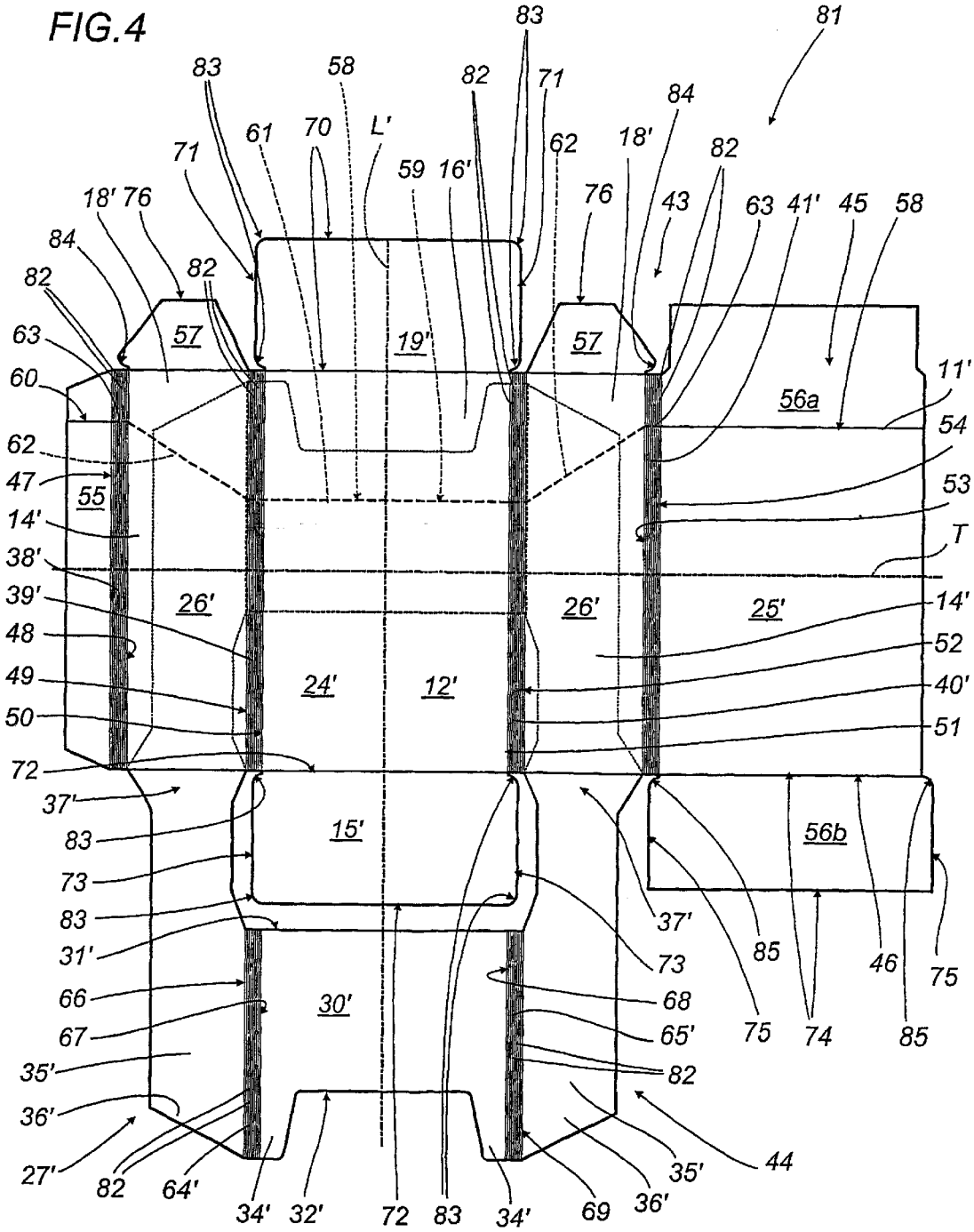
FIG. 4 is the plan view of a diecut blank from which to fashion the wrapper of FIG. 3.

Accordingly, the wrapper 80 is fashioned from a flat diecut blank 81 illustrated in FIG. 4 which differs from the blank 42 of FIG. 2, firstly, in that it exhibits a plurality of longitudinal crease lines 82 extending along each fillet 38', 39' 40' and 41' of the main portion 43 and each fillet 64' and 65' of the appendage 44. In addition, the first profiles 77 of the first end folds 19' and 15', the second profiles 79 of the transverse end flaps 57 and the third profiles 78 of the third end fold 56*b* appear respectively as rounded edges 83, 84 and 85 of circular outline.

Figure 5:
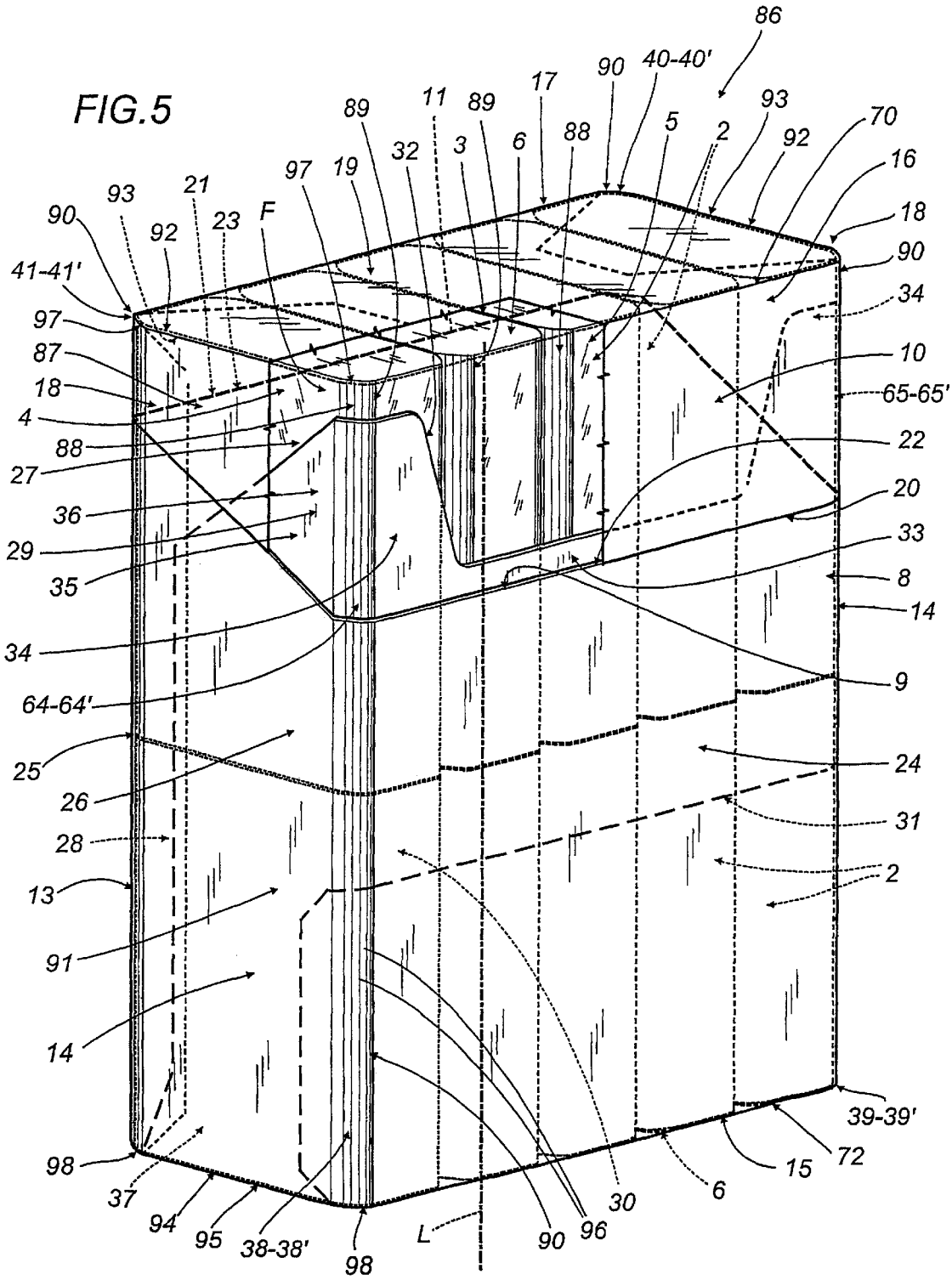
FIG. 5 illustrates a third embodiment of a rigid wrapper according to the present invention, viewed in perspective.

FIG. 5 illustrates a wrapper 86 designed to contain packets 2 of the type described in patent application PCT/IT99/00222, to which reference may be made for a full description. The front face 3 and the rear face 4 of the single packet 2 exhibit a substantially convex profile composed of a flat central portion 87 and two precreased and curved lateral bands 88 by which the central portion 87 is joined to the flank faces 5 of the packet along respective sharp corner edges 89 extending parallel to the longitudinal axis L.

The wrapper 86 in question is notably similar to the wrapper 1 of FIG. 1, and the various parts are denoted where possible by the same reference numbers as used to identify the corresponding parts of this same wrapper 1.

In particular, observing FIG. 5, the two flank faces 26 of the wrapper 86 are disposed mutually parallel and appear substantially convex, extending substantially perpendicular to the front and rear faces 24 and 25 which are connected to the flank faces 26 along respective sharp corner edges 90. Moreover, in similar fashion to the wrappers 1 and 80 already described, the wrapper 86 comprises a container 8 of cupped embodiment with an open top end 9, surmounted by a lid 10 likewise of cupped embodiment, hinged to the container 8 along a relative crease line 11 and rotatable thus between a position (not indicated) in which the top end 9 is open, and a position in which the top end 9 is closed (FIG. 5).

The container 8 presents a bottom end face 15 and the lid 10 a top end face 19, disposed orthogonally to the four remaining faces 24, 25 and 26.

Each of the flank faces 26 presents a respective flat central part 91 of substantially rectangular shape delimited uppermost by a rectilinear central portion 92 of one shorter side edge 93 of the top end face 19, and at the bottom by a rectilinear central portion 94 of one shorter side edge 95 of the bottom end face 15.

Each flank face 26 additionally comprises a pair of longitudinal lateral bands denoted 38', 41' and 39', 40' respectively, extending each along either side of the relative flat central part 91 between the selfsame central part 91 and a relative sharp corner edge 90.

Each of the four bands 38', 39', 40' and 41' is rendered pliable by crease lines 96 impressed on the inside surface, in such a way as will enable it to assume a curved position with the concave side facing inwards, and exhibits a top axial extremity offered to a curved end portion 97 of the relative shorter side edge 93 of the top end face 19, and a bottom axial extremity offered to a curved end portion 98 of the relative shorter side edge 95 of the bottom end face 15.

Figure 7:
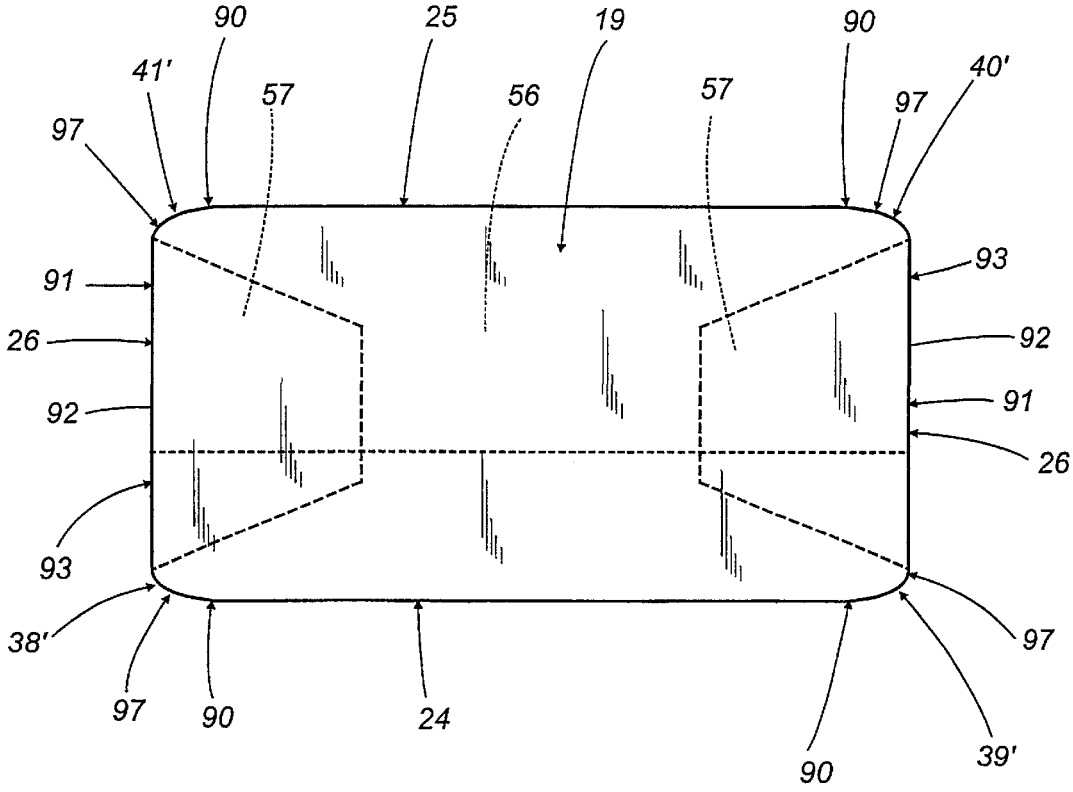
FIGS. 7 and 8 show the wrapper of FIG. 5 in plan respectively from above and from beneath.
Figure 8:
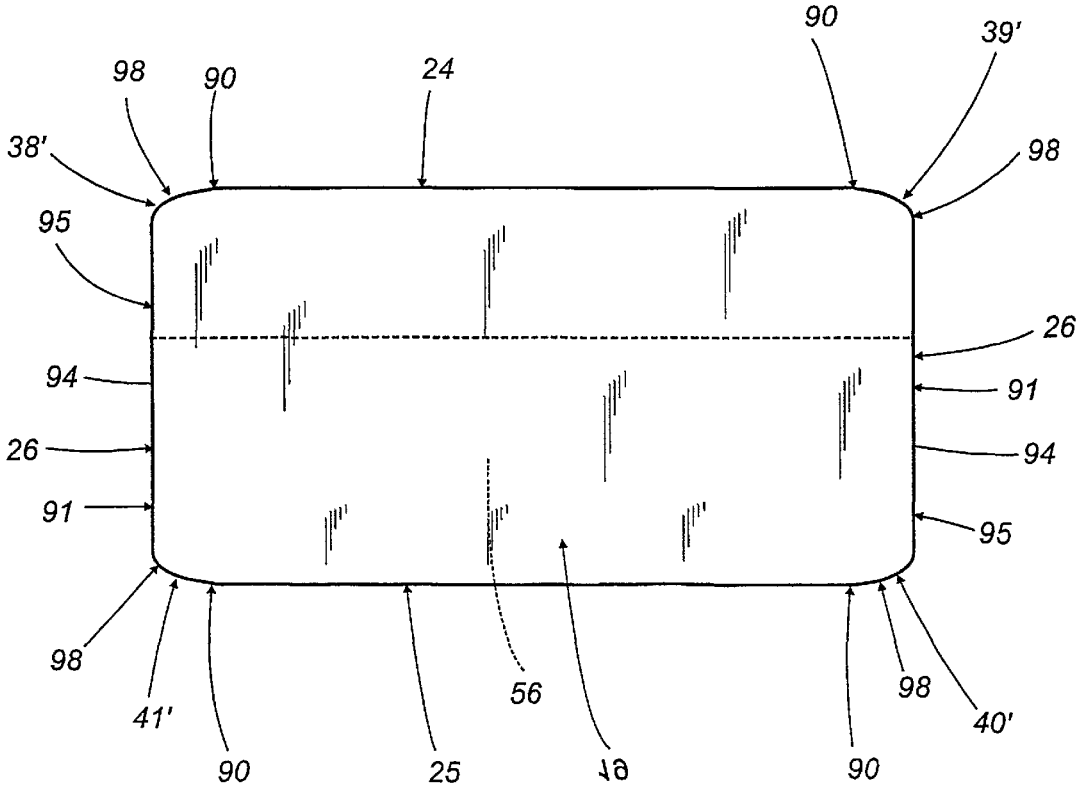

It will be discernible from the foregoing, as indicated clearly in FIGS. 7 and 8, that the distance between the central parts 91 of the two flank faces 26 is greater than the distance between the corner edges 90 of the front and rear faces 24 and 25, and that the connecting elements 38, 39, 40 and 41, as discernible from FIG. 5, consist in respective longitudinal bands 38', 39', 40' and 41' rendered pliable by longitudinal crease lines 96.

Figure 6:
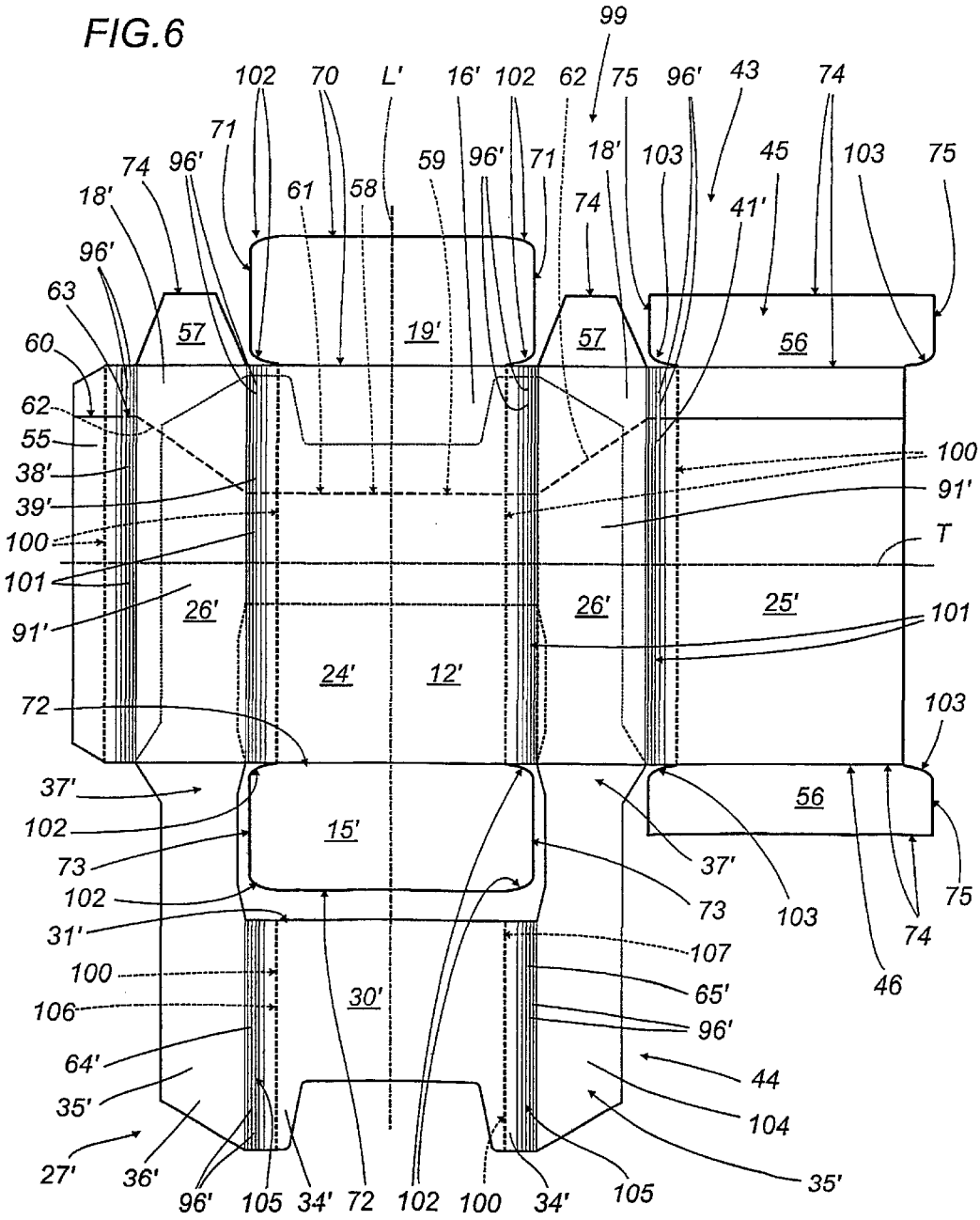
FIG. 6 is the plan view of a diecut blank from which to fashion the wrapper of FIG. 5.

Accordingly, the wrapper 86 is fashioned from a diecut blank 99, illustrated in FIG. 6, differing from the blank 42 of FIG. 2 firstly in that it exhibits a plurality of second longitudinal crease lines 100 positioned such that each of the lateral portions 26' is divided into a flat central part 91' and two longitudinal parts 101 precreased by longitudinal crease lines 96'.

The longitudinal parts 101 are disposed one on either side of the flat central part 91' of each lateral portion 26'.

In addition, the central panel 24' is associated with two first end folds 19' and 15' at the two longitudinal extremities, whilst the end panel 25' is associated with two second end folds 56 in this instance identical one with another.

Each first end fold 19' and 15' presents first connecting profiles 102 coinciding one with each end portion of the respective longer side edges 70 and 72, by which the longer and the shorter side edges 70 and 71 of the one end fold 19' and the longer and the shorter side edges 73 and 74 of the other end fold 15' respectively are interconnected.

Each second end fold 56 presents third connecting elements 103 one coinciding with each end portion of a respective longer side edge 74 lying nearer the first transverse crease line 45 and the second transverse crease line 46 respectively, by which the relative longer side edges 74 and the adjoining shorter side edges 75 are interconnected.

In particular, the profiles 102 and 103 adjoining the first and second transverse crease lines 45 and 46 extend from the respective second longitudinal crease lines 100.

As illustrated in FIGS. 5 and 6, moreover, the profiles 102 of the first end fold 19' connecting the longitudinal shorter side edges 71 with the transverse longer side edges 70 will coincide with the aforementioned curved end portions 97 of the shorter side edges 93 of the top end face 19 of the wrapper 86, and the shorter side edges 71 with the rectilinear central portions 92 of the selfsame side edges 93.

In like manner, the profiles 102 of the first end fold 15' connecting the longitudinal shorter side edges 73 with the transverse longer side edges 72 will coincide with the aforementioned curved end portions 98 of the shorter side edges 95 of the bottom end face 15 of the wrapper 86, and the shorter side edges 73 with the rectilinear central portions 94 of the selfsame side edges 95.

Thus, the respective opposite axial extremities of the bands 38', 39', 40' and 41' extend along the aforementioned curved end portions 97 and 98 of the edges presented by the top and bottom end faces 19 and 15, though without being connected thereto.

As discernible from FIG. 6, the longitudinal appendage 44 of the blank presents two respective second longitudinal crease lines 100 aligned with the two corresponding lines 100 located on either side of the central panel 24' of the main portion 43.

The crease lines 100 serve to divide each arm 35' into a flat part 104 and a longitudinal part 105 rendered pliable by longitudinal crease lines 106 in such a way as to establish respective precreased longitudinal bands 64' and 65' by way of which the two arms 35' are joined to the transverse panel 30' along respective sharp corner edges 107 coinciding with the second crease lines 100.

The precreased longitudinal bands 64' and 65' are positioned so as to coincide ultimately with the longitudinal bands 39' and 40' interconnecting the two lateral portions 26' and the central panel 24', likewise the sharp edges 107 of the appendage with the sharp edges 90 of the main portion.

What is claimed is:

1. A rigid wrapper for packets of cigarettes, the wrapper (1; 80; 86) comprising a hinged lid (10) and appearing substantially as a rectangular parallelepiped with a predominating longitudinal axis (L), presenting a front face (24) and a rear face (25), a first end face (19) and a second end face (15), top and bottom respectively, and two mutually parallel flank faces (26), the wrapper being fashioned from a flat blank (42; 81; 99) and presenting a first longitudinal axis (L') parallel to the predominating axis (L) and a second transverse axis (T) perpendicular to the first axis, comprising a main portion (43) ultimately providing the container (8) and the lid (10) of the wrapper (1), and a longitudinal appendage (44) ultimately providing the frame (27), wherein the main portion (43) of the blank (42; 81; 99) presents a first and a second transverse crease line (45, 46) extending parallel to the transverse axis (T) and a plurality of first longitudinal crease lines (47 . . . 54) extending parallel to the longitudinal axis (L'), combining with the first and second transverse crease lines (45, 46) to delimit a front central panel (24'), two lateral portions (26') lying one on either side of the central panel (24'), and an end panel (25') and a longitudinal end flap (55) lying externally of the respective lateral portions (26'), the central panel (24') associated at the two opposite longitudinal extremities with two first end folds (19', 15'), and the end panel (25') associated at the two opposite longitudinal extremities respectively with a second end fold (56*a*) to which it is joined along the first transverse crease line (45), and a third end fold (56*b*), opposite the second end fold (56*a*), to which it is joined along the second transverse crease line (46); each lateral portion (26') associated at the longitudinal extremity delimited by the first transverse crease line (45) with a relative transverse end flap (57); the appendage (44) presenting a substantially U shaped appearance and comprising two lateral arms (35'), also a transverse panel (30') associated on either side with the two arms (35') by way of two respective first longitudinal crease lines (66, 67; 68, 69); the appendage (44) being hinged by the two arms (35') to corresponding longitudinal ends of the respective lateral portions (26') coinciding with the second transverse crease line (46), and surrounding one first end fold (15') of the central panel (24'); the main portion (43) of the blank exhibiting a transverse perforation line (58) extending across the front central panel (24') and the two lateral portions (26'), along which the lid (10) is separated from the container (8), joined at one end to a transverse crease line (11') extending across the end panel (25') and at the other end to a perforation line (60) extending across the longitudinal end flap (55), the crease and perforation lines (11', 60) coinciding with the hinge line (11) along which the lid (10) is joined to the container (8); the one first end fold (19') being designed to overlap with the corresponding second end fold (56*a*) and combine with the end flaps (57), bent along the first transverse crease line (45), to constitute a first top end face (19) of the lid (10); the other first end fold (15') being designed to overlap with the corresponding third end fold (56*b*), bent along the second transverse crease line (46), to constitute a second bottom end face (15) of the container (8); the longitudinal end flap (55) being designed to overlap with a marginal portion of the inside surface of the end panel (25'); the appendage (44) being bent double along the second transverse crease line (46), flattened against the main portion (43) and fixed to the inside surfaces of the central panel (24') and of the lateral portions (26') directed toward the inside of the wrapper (1; 80; 86); at least each first end fold (19', 15') presenting a first profile (77) coinciding with at least one end portion of a respective longer side edge (70, 72) disposed adjacent to the respective first or second transverse crease line (45, 46), and connecting the respective longer side edge (70, 72) with a shorter side edge (71, 73) of the respective first end fold (19', 15') adjoining the selfsame longer side edge (70, 72); the third end fold (56*b*) presenting a third profile (78) coinciding with at least one end portion of a respective longer side edge (74) disposed adjacent to the second transverse crease line (46), and connecting the longer side edge (74) with a shorter side edge (75) of the third end fold (56*b*) adjoining the selfsame longer side edge (74); the first and third connecting profiles (77, 78) coinciding, when the wrapper (1; 80; 86) is erected, with the longitudinal connecting elements (38, 39, 40, 41) both of the lid (10) and of the container (8).

2. A wrapper as in claim 1, wherein at least one of the two arms (35') of the longitudinal appendage (44) is associated with the transverse panel (30') by way of a connecting element (64, 65) such as can be flattened against a longitudinal connecting element (38, 39, 40, 41) coinciding with the first and third profiles (77, 78) interconnecting a respective longer side edge (70, 72, 74) and a respective shorter side edge (71, 73, 75) of each of the first end folds (19', 15') and third end folds (56*b*).

3. A wrapper as in claim 1, wherein at least one of the two transverse end flaps (57) interposed along the first transverse crease line (45) either between the first end fold (19') and the end panel (25') or between the first end fold (19') and the longitudinal end flap (55), respectively, presents a second profile (79) located on a part of the peripheral edge (76) directed toward the end panel (25') or toward the longitudinal end flap (55), by which the selfsame peripheral edge (76) is connected to the first transverse crease line (45); the second connecting profile (79) and a relative first connecting profile (77) or a relative third connecting profile (78) together coinciding with a longitudinal connecting element (38, 39, 40, 41).

4. A wrapper as in claim 1, wherein each first end fold (19', 15') presents a first profile (77) coinciding with each end portion of a respective longer side edge (70, 72), connecting the longer side edges (70, 72) with the adjoining shorter side edges (71, 73); each of the two transverse end flaps (57) presenting a second profile (79) located on a part of the peripheral edge (76) directed toward the end panel (25') or toward the longitudinal end flap (55), by which the selfsame peripheral edge (76) is connected to the first transverse crease line (45); the third end fold (56*b*) presenting a third profile (78) coinciding with each end portion of a respective longer side edge (74), connecting the longer side edge (74) with the shorter side edges (75); each second connecting profile (79), together with the first connecting profiles (77) of the first end folds (19', 15') and with the third connecting profiles (78) of the third end fold (56*b*), coinciding with a longitudinal connecting element (38, 39, 40, 41) of the wrapper (1; 80; 86); each of the two arms (35') of the longitudinal appendage (44) being associated with the transverse panel (30') by way of a connecting element (64, 65) such as can be flattened against a longitudinal connecting element (38, 39, 40, 41) interconnecting the central panel (24') and the lateral portions (26').

5. A wrapper as in claim 1, wherein the first, second and third connecting profiles (77; 79; 78) are rectilinear.

6. A wrapper as in claim 1, wherein the first, second and third connecting profiles (77; 79; 78) are rounded.

7. A wrapper as in claim 1, wherein the main portion (43) presents a first and a second transverse crease line (45, 46) and a plurality of second longitudinal crease lines (100), at least one of the second longitudinal crease lines (100) dividing at least one of the lateral portions (26') into a flat part (91') and a longitudinal part (101) rendered pliable by a longitudinal crease lines (96'), the central panel (24') associated at the two opposite longitudinal extremities with two first end folds (19', 15') and the end panel (25') associated at the two opposite longitudinal extremities with two second end folds (56); each first and second end fold (19', 15'; 56) presenting at least one respective first and third profile (102; 103) coinciding with an end portion of a respective longer side edge (70, 72; 74) disposed adjacent to the respective first and second transverse crease line (45, 46), and directed toward the corresponding end portion of a respective longer side edge (74; 72, 70) of the second and first end fold (56; 15', 19'), by which the selfsame longer side edge (70, 72; 74) is connected to a shorter side edge (71, 73; 75) of the first and second end folds (19', 15'; 56) adjoining the longer side edge (70, 72; 74); the first and third profiles (102; 103) extending from the longer side edge (70, 72; 74) of the relative first and second end folds (19', 15'; 56) at a point coinciding with a second longitudinal crease line (100) adjacent respectively to the central panel (24') and to the end panel (25') and, when the wrapper (86) is erected, offered to the respective opposite axial extremities of each precreased longitudinal band (38', 39', 40', 41') in such a way as to establish the longitudinal element (38, 39, 40, 41) by which the flat part (91) of one of the side faces (26) is connected with the front face (24) or the rear face (25) along the relative sharp corner edge (90), thus coinciding with the precreased longitudinal connecting band (38', 39', 40', 41') both of the lid (10) and of the container (8).

8. A wrapper as in claim 7, wherein the longitudinal appendage (44) presents at least one second longitudinal crease line (100) dividing at least one of the two arms (35') into a flat part (104) and a longitudinal part (105) rendered pliable by longitudinal crease lines (106) in such a way as to establish a respective precreased longitudinal band (64', 65') by way of which the arm (35') is joined to the transverse panel (30') along a respective sharp corner edge (107); the precreased longitudinal band (64', 65') being flattened ultimately against the precreased longitudinal connecting band (39', 40') coinciding with the first profiles (102) connecting a respective longer side edge (70, 72) and shorter side edge (71, 73) of each of the first end folds (19', 15') and extending from the longer side edge (70, 72) at a point coinciding with a second longitudinal crease line (100).

9. A wrapper as in claim 7, wherein each first and second end fold (19', 15'; 56) presents a respective first and third profile (102; 103) coinciding with the end portions of a respective longer side edge (70, 72; 74) disposed adjacent to the respective first and second transverse crease line (45, 46), connecting the selfsame longer side edge (70, 72; 74) to a shorter side edge (71, 73; 75) of the first and second end folds (19', 15'; 56) adjoining the longer side edge (70, 72; 74); the first and third profiles (102; 103) extending from the longer side edge (70, 72; 74) of the relative first and second end folds (19', 15'; 56) at points coinciding with second longitudinal crease lines (100) adjacent respectively to the central panel (24') and to the end panel (25') and, when the wrapper (86) is erected, offered to the respective opposite axial extremities of each precreased longitudinal band (38', 39', 40', 41') in such a way as to establish the longitudinal element (38, 39, 40, 41) by which the flat part (91) of one of the side faces (26) is connected with the front face (24) or the rear face (25) along the relative sharp corner edge (90), thus coinciding with the precreased longitudinal connecting band (38', 39', 40', 41') both of the lid (10) and of the container (8).

10. A wrapper as in claim 7, wherein each first end fold (19', 15') presents a first profile (102) coinciding with each end portion of a respective longer side edge (70, 72) and connecting the relative longer side edge (70, 72) with the shorter side edges (71, 73); each second end fold (56) presenting a second profile (103) coinciding with each end portion of a respective longer side edge (74) and connecting the longer side edge (74) with the adjoining shorter side edges (75); the first and third profiles (102, 103), when the wrapper (86) is erected, being offered to the respective opposite axial extremities of each precreased longitudinal band (38', 39', 40', 41') in such a way as to establish the longitudinal element (38, 39, 40, 41) by which the flat parts (91) of the side faces (26) are connected with the front face (24) and the rear face (25) each along the relative sharp corner edge (90), thus coinciding with the precreased longitudinal connecting bands (38', 39', 40', 41') both of the lid (10) and of the container (8); the longitudinal appendage (44) presenting two second longitudinal crease lines (100) dividing the arms (35') each into a flat part (104) and a longitudinal part (105) rendered pliable by longitudinal crease lines (106) establishing a respective precreased longitudinal band (64', 65') by way of which the arms (35') are joined to the transverse panel (30') each along a respective sharp corner edge (107); the precreased longitudinal bands (64', 65') being flattened ultimately against the precreased longitudinal connecting bands (39', 40') coinciding with the first profiles (102) connecting a respective longer side edge (70, 72) and shorter side edge (71, 73) of each of the first end folds (19', 15') and extending from the longer side edge (70, 72) at a point coinciding with a second longitudinal crease line (100).

11. A wrapper as in claim 2, wherein each first end fold (19', 15') presents a first profile (77) coinciding with each end portion of a respective longer side edge (70, 72), connecting the longer side edges (70, 72) with the adjoining shorter side edges (71, 73); each of the two transverse end flaps (57) presenting a second profile (79) located on a part of the peripheral edge (76) directed toward the end panel (25') or toward the longitudinal end flap (55), by which the selfsame peripheral edge (76) is connected to the first transverse crease line (45); the third end fold (56*b*) presenting a third profile (78) coinciding with each end portion of a respective longer side edge (74), connecting the longer side edge (74) with the shorter side edges (75); each second connecting profile (79), together with the first connecting profiles (77) of the first end folds (19', 15') and with the third connecting profiles (78) of the third end fold (56*b*), coinciding with a longitudinal connecting element (38, 39, 40, 41) of the wrapper (1; 80; 86); each of the two arms (35') of the longitudinal appendage (44) being associated with the transverse panel (30') by way of a connecting element (64, 65) such as can be flattened against a longitudinal connecting element (38, 39, 40, 41) interconnecting the central panel (24') and the lateral portions (26').

12. A wrapper as in claim 3, wherein each first end fold (19', 15') presents a first profile (77) coinciding with each end portion of a respective longer side edge (70, 72), connecting the longer side edges (70, 72) with the adjoining shorter side edges (71, 73); each of the two transverse end flaps (57) presenting a second profile (79) located on a part of the peripheral edge (76) directed toward the end panel (25') or toward the longitudinal end flap (55), by which the selfsame peripheral edge (76) is connected to the first transverse crease line (45); the third end fold (56*b*) presenting a third profile (78) coinciding with each end portion of a respective longer side edge (74), connecting the longer side edge (74) with the shorter side edges (75); each second connecting profile (79), together with the first connecting profiles (77) of the first end folds (19', 15') and with the third connecting profiles (78) of the third end fold (56*b*), coinciding with a longitudinal connecting element (38, 39, 40, 41) of the wrapper (1; 80; 86); each of the two arms (35') of the longitudinal appendage (44) being associated with the transverse panel (30') by way of a connecting element (64, 65) such as can be flattened against a longitudinal connecting element (38, 39, 40, 41) interconnecting the central panel (24') and the lateral portions (26').

13. A wrapper as in claim 2, wherein the first, second and third connecting profiles (77; 79; 78) are rectilinear.

14. A wrapper as in claim 3, wherein the first, second and third connecting profiles (77; 79; 78) are rectilinear.

15. A wrapper as in claim 4, wherein the first, second and third connecting profiles (77; 79; 78) are rectilinear.

16. A wrapper as in claim 2, the first, second and third connecting profiles (77; 79; 78) are rounded.

17. A wrapper as in claim 3, wherein the first, second and third connecting profiles (77, 79; 78) are rounded.

18. A wrapper as in claim 4, wherein the first, second and third connecting profiles (77, 79; 78) are rounded.

19. A wrapper as in claim 8, wherein each first end fold (19', 15') presents a first profile (102) coinciding with each end portion of a respective longer side edge (70, 72) and connecting the relative longer side edge (70, 72) with the shorter side edges (71, 73); each second end fold (56) presenting a second profile (103) coinciding with each end portion of a respective longer side edge (74) and connecting the longer side edge (74) with the adjoining shorter side edges (75); the first and third profiles (102, 103), when the wrapper (86) is erected, being offered to the respective opposite axial extremities of each precreased longitudinal band (38', 39', 40', 41') in such a way as to establish the longitudinal element (38, 39, 40, 41) by which the flat parts (91) of the side faces (26) are connected with the front face (24) and the rear face (25) each along the relative sharp corner edge (90), thus coinciding with the precreased longitudinal connecting bands (38', 39', 40', 41') both of the lid (10) and of the container (8); the longitudinal appendage (44) presenting two second longitudinal crease lines (100) dividing the arms (35') each into a flat part (104) and a longitudinal part (105) rendered pliable by longitudinal crease lines (106) establishing a respective precreased longitudinal band (64', 65') by way of which the arms (35') are joined to the transverse panel (30') each along a respective sharp corner edge (107); the precreased longitudinal bands (64', 65') being flattened ultimately against the precreased longitudinal connecting bands (39', 40') coinciding with the first profiles (102) connecting a respective longer side edge (70, 72) and shorter side edge (71, 73) of each of the first end folds (19', 15') and extending from the longer side edge (70, 72) at a point coinciding with a second longitudinal crease line (100).

20. A wrapper as in claim 9, wherein each first end fold (19', 15') presents a first profile (102) coinciding with each end portion of a respective longer side edge (70, 72) and connecting the relative longer side edge (70, 72) with the shorter side edges (71, 73); each second end fold (56) presenting a second profile (103) coinciding with each end portion of a respective longer side edge (74) and connecting the longer side edge (74) with the adjoining shorter side edges (75); the first and third profiles (102, 103), when the wrapper (86) is erected, being offered to the respective opposite axial extremities of each precreased longitudinal band (38', 39', 40', 41') in such a way as to establish the longitudinal element (38, 39, 40, 41) by which the flat parts (91) of the side faces (26) are connected with the front face (24) and the rear face (25) each along the relative sharp corner edge (90), thus coinciding with the precreased longitudinal connecting bands (38', 39', 40', 41') both of the lid (10) and of the container (8); the longitudinal appendage (44) presenting two second longitudinal crease lines (100) dividing the arms (35') each into a flat part (104) and a longitudinal part (105) rendered pliable by longitudinal crease lines (106) establishing a respective precreased longitudinal band (64', 65') by way of which the arms (35') are joined to the transverse panel (30') each along a respective sharp corner edge (107); the precreased longitudinal bands (64', 65') being flattened ultimately against the precreased longitudinal connecting bands (39', 40') coinciding with the first profiles (102) connecting a respective longer side edge (70, 72) and shorter side edge (71, 73) of each of the first end folds (19', 15') and extending from the longer side edge (70, 72) at a point coinciding with a second longitudinal crease line (100).

* * * * *